United States Patent [19]

Fiocca et al.

[11] 3,963,930

[45] June 15, 1976

[54] SYSTEM FOR CONTROLLING OPERATION OF THE ROTATING ANODE OF AN X-RAY TUBE

[75] Inventors: Louis L. Fiocca, Bensenville; Joel J. Schmutzer, Oak Park; John I. Klusendorf, Schaumberg, all of Ill.

[73] Assignee: Advanced Instrument Development, Inc., Melrose Park, Ill.

[22] Filed: Dec. 5, 1974

[21] Appl. No.: 529,735

[52] U.S. Cl. ..... 250/402; 250/406

[51] Int. Cl.[2] ..... H05G 1/70

[58] Field of Search ..... 250/401, 402, 406, 416; 313/60

[56] References Cited

UNITED STATES PATENTS 3,244,884 4/1966 McLaughlin ..... 250/406

3,641,408 2/1972 Flocca ..... 250/406

*Primary Examiner*—Craig E. Church

*Attorney, Agent, or Firm*—Leo J. Aubel

[57] ABSTRACT

A closed loop system is disclosed for monitoring and regulating the power applied to the stator of an induction motor for controlling the operation of the rotating anode of an X-ray tube in order to insure acceleration of the rotor to a selected speed of rotation, to maintain the selected speed of rotation, and to provide a braking voltage to the rotor as desired. The system provides direct inter-related operation of an anode rotor, an anode rotor rotation sensing detector, and an X-ray generator.

7 Claims, 3 Drawing Figures

SYSTEM FOR CONTROLLING OPERATION OF THE ROTATING ANODE OF AN X-RAY TUBE

BACKGROUND OF THE INVENTION

In rotating anode type of X-ray tubes, it is desirable to provide a means to assure that the anode has attained a selected rotational speed prior to the electron bombardment of the anode and the generation of X-rays. Certain prior art systems utilize time dependent apparatus for accelerating the anodes. In such prior art devices, a boost or acceleration signal is applied to the anode to start the anode rotating, and the generation of the X-rays and the bombardment of the anode is delayed for a fixed period of time to enable the anode to reach a selected rotational speed before the X-rays bombard on the anode. However, in boosting the speed of the anode to the desired speed, the prior art relies on a boost signal which is applied to the associated stator for a pre-selected fixed time and there is no other control to assure that the anode is actually rotating at the selected desired speed at the termination of the time period of the boost signal.

In prior art systems, the rotating anodes of the tubes are generally driven with split phase motors and the motors are operated from power sources capable of providing either a 60 Hz or 180 Hz AC control power to enable operation at rotational speeds of approximately 3,600 RPM or 10,800 RPM, respectively. Such two speed drive systems are normally preferred over single speed drives because the high speed drive provides greatly improved X-ray tube operating ratings and loadings.

As disclosed in U.S. Pat. No. 3,641,408, to provide a source of both 60 Hz and 180 Hz power supply, two separate starter systems have been employed wherein the anode system obtains a first source of power at a line frequency power and another source of power at a multiple of the line frequency. Further, each drive system requires means for providing either a normal running voltage and a relatively higher boost voltage. The boost voltage is used to accelerate the anode to obtain the desired speed of rotation in the shortest possible time, whether it be the low speed 3,600 RPM rotation or the 10,800 RPM rotation.

As an X-ray tube is used repeatedly, the associated mechanical and support assembly of the rotating anode heats up and more power is dissipated. As the tube housing gets hotter, the associated stator loses efficiency since its resistance goes higher, while the inductance remains fixed and causes more power to be dissipated in the form of heat in the windings and less power is transmitted to the anode rotor. Thus, it has been found that after the tube gets hot, most stators do not receive the required amount of energy to drive the anode to attain the desired running speed.

Another problem of rotating anode tubes is the vibration caused by the mechanical resonance of the anode system. In presently available tubes, the mechanical resonance of the system is at approximately 6,000 RPM. Accordingly, it is desirable that the anode be accelerated and decelerated or braked through this mechanical resonance point in a minimum of time to reduce any wear and damage caused by vibration as the anode speed goes through this point.

SUMMARY OF THE INVENTION

The present invention discloses a closed loop or feedback control circuit for an X-ray tube having a rotatable anode. The inventive closed loop system includes a motor control system for providing accurate precise control of the starting power applied to the stator cord of a split phase motor which drives the anode to accelerate the rotor to a pre-selected speed, and to control the deceleration of the rotor. Further, the present system provides power at a multiple of the input frequency and accurate precise control of that power applied to the stator cord to accelerate the rotor to a higher rotating speed suitable for operating the X-ray tube at a higher power rating.

More specifically, the present invention includes a feedback loop comprising the control circuits of an associated X-ray generator, circuitry for sensing the rotating speed of the rotatable anode and motor control circuits.

In the low speed mode of operation, the system provides means for controllably switching the power at a first frequency directly to the stator of the split phase motor to drive the rotor to a desired speed. The rotation sensing detector detects when the rotor is rotating at the selected speed at which time the X-ray generator can be activated to obtain an X-ray exposure.

The system includes means for developing a relatively frequency which is multiple of the input power frequency, inverter means for providing output power corresponding to said multiple frequency and solid state switching means for controllably applying power to drive said stator in accordance with said high frequency. The high speed mode of operation is determined by the sequencing logic which closes the solid state switching means and associated relays to provide the power at the multiple frequency to drive the rotor at the selected high speed.

The present invention further includes circuitry operable to provide a D.C. braking voltage to the stator cord to thereby brake the rotor. This operation is initiated by a sequencing logic which closes selected relays coupled through a rectifier to a source of power, to thereby provide a rectified pulsating D.C. to the stator cord to provide a braking action for a period determined by the rotation detector and the sequencing logic.

The foregoing and other objects, features and advantages of the invention will be apparent from the following more particular description of preferred embodiments of the invention as illustrated in the accompanying drawings wherein:

DESCRIPTION OF THE INVENTION

Figure 1:
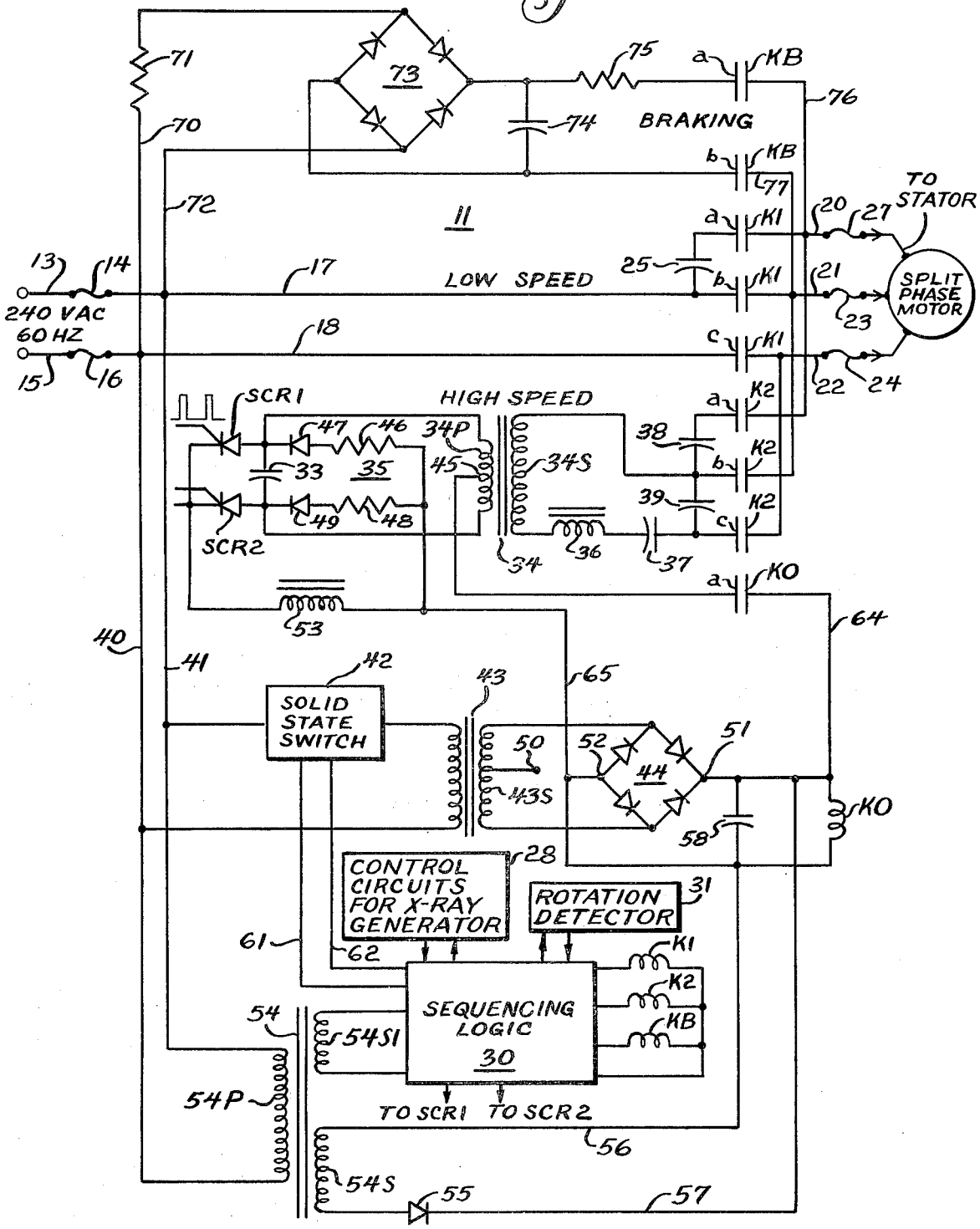
FIG. 1 is a circuit diagram of the motor control switching circuit.
Figure 2:
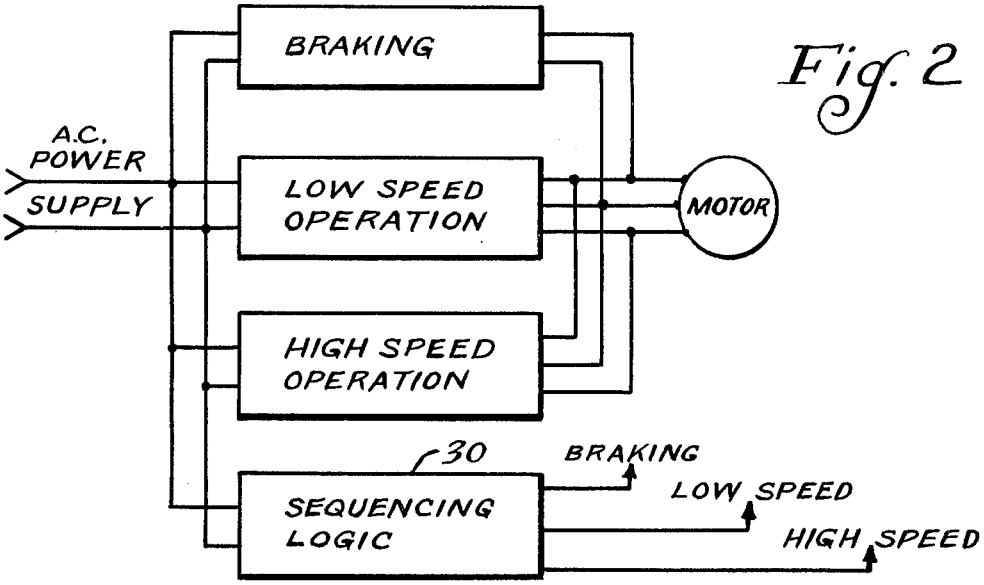
FIG. 2 is a block diagram of the circuit of FIG. 1.
Figure 3:
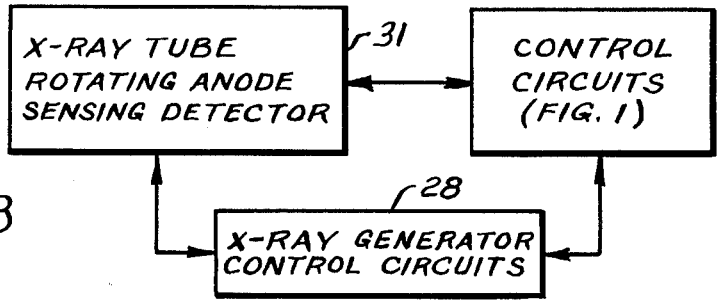
FIG. 3 is a block diagram showing the inventive closed loop system.

Refer to FIGS. 1, 2 and 3. The inventive system is shown in FIGS. 1 and 3 while FIG. 2 shows a block diagram of FIG. 1.

Consider first the low speed operating mode portion of the motor control circuit 11 of FIGS. 1 and 2, labeled "Low Speed" on the drawings. A 240 volts AC 60 Hz supply, such as from a commercial power source is coupled through leads 13 and 15, suitble fuses 14 and 16, and leads 17 and 19, respectively, to one side of contacts *b* and *c* of a relay K1. Lead 17 also couples through capacitor 25 to contact *a* of relay K1. The other side of the contacts *b* and *c* connect through leads 21 and 22 and fuses 23 and 24, respectively, to two leads of the stator cord of the associated split-phase motor which drives the anode of the X-ray tube, not shown. The other side of contact *a* of relay K1 is connected through lead 20 and fuse 27 to the third lead of the stator cord. Capacitor 25 provides additional current phase shift for the motor, as is known in the art.

Consider now the high speed operating mode portion of the motor control circuit 11, labeled as "High Speed" in the drawings. The 240 volts 60 Hz supply is connected through leads 40 and 41 to the primary winding 54P of a transformer 54. A secondary winding 54S1 of transformer 54 provides power to a sequencing logic circuit 30 which may be of any suitable type known in the art such as a pre-programmed panel, or it may comprise an input from an associated data processor or miniature computer. The sequencing logic circuit 30 initiates operation of the overall circuit 11 in response to input commands and provide subsequent controls and commands dependent on the selected operating conditions.

The sequencing logic circuit 30 selectively energizes the low speed operation relay K1, the high speed operation relay K2; and the braking relay KB. Sequencing logic circuit 30 also provides a control signal through leads 61 and 62 to a switch 42 which in this embodiment is a solid state switch of any suitable known design, for purposes to be explained hereinafter. As will be explained with reference to FIG. 3, circuit 30 is inter-connected with an X-ray generator 28 of any suitable known design; and to a rotation detector 31 which may be of the type disclosed and claimed in a patent application Ser. No. 529,734 entitled "X-RAY TUBE ROTATING ANODE SENSING DETECTOR", filed in the names of Joel J. Schmutzer, John I. Klusendorf and James A. Grichnik and assigned to the same assignee as the present invention.

The logic circuit 30 may also include an electronic clock to provide clock pulses to the gate electrodes of SCR1 and SCR2 in an inverter 35 for purposes to be explained. The gate pulses for SCR1 and SCR2 may also be obtained by any other suitable means known in the art; such as an oscillator, one such means being described in Reissue Pat. No. RE 28,618 entitled "SOLID-STATE POWER SUPPLY SYSTEM FOR ROTATING ANODE X-RAY TUBES", in the name of Louis L. Fiocca, and assigned to the same assigned as the present invention.

In the embodiment shown, the high frequency of interest is 180 Hz and the gate pulses applied to the gates of each of SCR1 and SCR2 are spaced apart 5.5 milliseconds and have a pulse duration of about 200 microseconds. The time spacing between a pulse applied to SCR1 and a succeeding pulse to SCR2 is 2.75 milliseconds.

When activated by the logic circuit 30 through leads 61 and 62, the switch 42 closes to connect the 240 volt AC 60 Hz supply through leads 40 and 41 to transformer 43.

The secondary winding 43S of transformer 43 couples to a full wave diode rectifier bridge circuit 44. The rectified output of bridge 44 is coupled across capacitor 48 and thence through lead 64 to the center tap 45 of the primary winding 34P of inverter transformer 34. The bridge 44 is also coupled through lead 65, series resistor 46 and diode 47 to the upper terminal of primary winding 34P, and also through series resistor 48 and diode 49 to the lower terminal of primary winding 34P. A choke 53 connects lead 65 to the cathodes of SCR1 and SCR2.

Secondary winding 54S of transformer 54 is connected through series diode 55 to the positive output terminal 51 of a bridge 44. The other side of secondary 54S is connected through lead 56 to the other or reference terminal 52 of rectifier bridge 44. An approximate 8 volts is provided by secondary winding 54S to provide an idle voltage to the inverter 35 to insure the inverter is continually on, or running, at a reduced power level to improve the reliability of the inverter.

The inverter 35 comprises silicon controlled rectifiers (SCRs) for developing an 180 Hz output signal. SCR1 and SCR2 are connected to provide a free running inverter commutated by a capacitor 33 in a conventional inverter circuit, such as for example, shown in Reissue Pat. No. Re 28,618 which inverter drives into the primary winding of a transformer 34. As mentioned hereinabove, the gate pulses to trigger SCR1 and SCR2 may be obtained from the sequencing logic circuit 30 or from a conventional oscillator.

The output of the secondary winding 34S of transformer 34 is coupled across capacitor 39 through a filter (such as an Ott filter) comprising a series connected inductance 35 and capacitor 37. One plate of capacitor 39 is connected through series capacitor 38 to contact *a* of relay K2 and thence to lead 20 and one terminal of the stator cord; the same terminal of capacitor 39 is also connected through contact *b* of relay K2 thence to lead 21 and another terminal of the stator cord. The other plate of capacitor 39 is connected through contact *c* of relay K2 to lead 22 and the reference terminal or lead of the stator cord.

Consider now the deceleration or braking mode portion of the circuit, indicated as "Braking" in the drawing.

The 240 VAC 60 Hz supply is also connected through a lead 70 and a series resistor 71 to one input terminal of a full wave diode bridge rectifier 73 and through a second lead 72 to the other input terminal of rectifier 73. A storage capacitor 74 is connected across the output terminals of rectifier 73. The positive output terminal of rectifier 73 is connected through series resistor 75 and contact *a* of brake relay KB to lead 20 and one terminal or lead of the stator cord. The other or reference terminal of rectifier 73 is connected through lead 77 and contact *b* of brake relay KB to lead 23 and a second terminal of the stator cord.

The operation of the inventive circuit will now be described. For the low speed operation of the anode rotor, the relay coil K1 is energized by the sequencing logic circuit 30 causing contacts *a*, *b* and *c* of relay K1 (upper right hand portion of the Figure) to close thereby enabling the 240 volt 60 Hz power to be applied through leads 17 and 19 and contacts *a*, *b* and *c* to the stator cord to boost the rotor to its desired low speed operating RPM, which, in this embodiment, is 3,600 RPM.

When the speed has been boosted to this RPM, the rotation detector 31 which may be of the type as disclosed in the above patent application, Ser. No. 529,734, senses that the rotor is rotating at the selected speed and provides a representative signal to the sequencing logic circuit 30. The sequencing logic circuit 30 then de-energizes the relay coil K1 and causing relay contacts *a*, *b* and *c* to open, and thereby interrupts the power to the stator cord.

For high speed operation of the anode rotor, the relay coil K2 is energized by the sequencing logic circuit 30. The inverter 35 and transformer 34 provide a 180 Hz drive through the relay contacts *a*, *b* and *c* of relay coil K2 to the stator cord. More specifically, when the sequencing logic circuit 30 indicates that a high speed is required, (in this embodiment, 10,800 RPM), and the rotation detector 31 senses that the anode rotor is not rotating or not rotating at the required speed, the rotation detector signals the sequencing logic circuit 30 to energize the relay K2 and close relay K2 contacts *a*, *b* and *c*. Concurrently therewith, the sequencing logic circuit 30 will provide a signal through lead 61 and 62 to close the solid state switch 42.

When solid state switch 42 closes, the 240 VAC 60 Hz is applied through solid state switch 42 to transformer 43. Rectifier 44 rectifies the alternating current from transformer 43 and couples this current to the center tap 45 of transformer 34.

In accordance with the input from inverter 34, transformer 34 provides the 240 VAC power at a frequency of 180 Hz and this power is coupled through contacts *a*, *b* and *c* of relay K2 to the stator cord, until the rotation detector 31 indicates that the rotor has accelerated to a speed of 10,800 RPM, at which point rotation detector 31 provides a signal to the sequencing logic circuit 30, to de-energize relay K2 and open contacts K2. When the rotation detector 31 indicates that the rotor is rotating at 10,800 RPM, the sequencing logic circuit 30 can provide an inter-locking signal to enable the X-ray generator 28 to initiate the X-ray exposure.

SCR1 and SCR2 may generate excessive noise; therefore, transformer 43 functions as an isolation transformer to isolate the rest of the power line and the control circuits from other auxiliary equipment. An additional tap 50 can be provided for transformer 43 to obtain a selected relatively lower run voltage for the stator. In certain applications, where noise is not a factor, the solid state switch 42 can couple directly to the input terminals of rectifier 44.

The X-ray generator 28 may provide signals to the sequencing logic circuit 30 indicating that the X-ray exposure has been completed and the sequencing logic circuit 30 can then provide signals to energize the relay KB to couple a braking DC voltage to the stator cord. To decelerate or brake the rotor, the sequencing logic circuit 30 energizes the relay KB to close its contacts *a* and *b* to thereby apply a DC voltage through leads 76 and 77 to the stator cord to decelerate the rotor. The logic circuit 30 thus causes the deceleration voltage to be applied dependent on the rotating speed of the rotor as sensed by the rotation detector 31. Also, the braking voltage may be applied until the rotation detector 31 senses that the rotor is below a speed of 6,000 RPM and a program sequence can be provided such that after the speed has been reduced to 6,000 RPM, the sequence logic circuit 30 provides a signal to maintin the braking voltage for a definite time period.

Another feature of the invention is as follows. Assume the rotor is initially accelerated to 10,800 RPM, the power supply is removed by opening relay K2 as discussed above and the speed of the rotor coasts down to say, 9,800 RPM. The rotation detector 31 will detect this change in speed and provide a representative signal to the sequencing logic circuit 30. The sequencing logic circuit 30 can then provide a signal to close the solid state switch 42 to couple a voltage to the stator to boost or accelerate the rotor up to 10,800 RPM.

Further, in another application, if for example, the X-ray exposure has been made and the high speed power has been turned off by opening up the solid state switch 42 and the rotor is coasting down or rotating at, say 3,000 RPM, it is then desired to take a second exposure. The rotation detector 31 can then provide a signal to the sequencing logic circuit 31 to apply the high speed power to accelerate the rotor up from the 3,000 RPM to 10,800 RPM.

Thus, proportional control is obtained; that is, once the rotor is rotating the voltage applied to the stator to boost the rotation speed is a relatively reduced voltage.

By inter-relating the X-ray generator 28, the rotation detector 31 and the inventive circuit 11, the life of the X-ray tube can be extended since the tube filament can be energized only for that time period desired and also the mechanical assembly including the bearings can be more efficiently used for only the desired periods of time.

Transformer 43 includes a run tap 50 which can be switched into the circuit whenever it is desired to rotate the rotor at a given running speed.

Fuses 14 and 16 can be provided in the circuit to protect the circuit from excessive currents. Also, the fuses 23, 24 and 27 such that if the stator cord is shorted, the inverter will not be loaded down excessively.

While the invention has been particularly shown and described with reference to a preferred embodiment thereof, it will be understood by those skilled in the art that various changes in form and details may be made therein without departing from the spirit and scope of the invention.

What is claimed is:

1. In an X-ray system, said system having an X-ray tube with a rotatable anode and an alternating current induction motor having a stator and a rotor for rotating said anode, said X-ray tube having an X-ray generator, control circuits for said generator, said system being connectable to a source of alternating current power at line frequency, the improvement comprising, closed loop control circuitry means for said X-ray system, including the X-ray generator control circuits, vibration responsive means for sensing the actual rotating speed of the anode and providing an output responsive thereto, and motor control means selectively operable to connect said source of power to said stator in response to the output from said sensing means, and means inter-connecting the X-ray generator control circuits, the sensing means, and the motor control means to provide said closed loop control circuitry means for regulating the rotor rotation at a selected speed, for enabling operation of said X-ray generator at least at said selected speed and for braking said rotor rotation.

2. A system as in claim 1 including means for providing current at a multiple of line frequency comprising means for developing clock pulses having a repetition rate corresponding to the frequency to which said line frequency is to be multiplied, solid state inverter means including rectifier means and an output transformer, and wherein the current from said rectifier means is coupled to a center tap of the primary of said output transformer to provide output power at said multiple frequency and at a relatively reduced level.

3. In an X-ray system as in claim 1 wherein said motor control means includes logic sequencing means for providing instruction signals, means for developing an alternating current at a multiple of said line frequency, and switching means responsive to said logic sequencing means for connecting the alternating current power at a multiple of said line frequency to the motor stator to thereby accelerate said rotor to a relatively high speed.

4. In an X-ray system as in claim 3 wherein said switching means comprises first electrical switch means closeable in response to said logic sequencing means to connect the source of power to said stator to accelerate said rotor to a first relatively low speed, current rectifier means, a switch device connecting the source of alternating current to said rectifier means, the means for developing a current at a multiple of the line frequency, comprising, inverter means and the switching means further including second electrical switch means closeable in response to said logic sequencing means for connecting said power at said multiple of said line frequency to said stator to thereby accelerate said rotor to a second relatively high speed.

5. A system as in claim 4 wherein said device comprises a switch and the system including an isolation transformer positioned intermediate said solid state switch means and said rectifier means.

6. A system as in claim 4 further including second means for providing a rectified voltage, third electrical switch means selectively closeable by said logic sequencing means to apply said rectified voltage to the stator to decelerate said rotor.

7. A system as in claim 6 further including means for providing an idle voltage to said inverter means to insure that the inverter is continually running at a reduced power level to improve reliability thereof.

* * * * *